US008342482B2

(12) United States Patent
Smith

(10) Patent No.: US 8,342,482 B2
(45) Date of Patent: Jan. 1, 2013

(54) PRY BAR WITH ADJUSTABLE AND LOCKABLE ARMS

(76) Inventor: David Carl Smith, Petal, MS (US)

( * ) Notice: Subject to any disclaimer, the term of this patent is extended or adjusted under 35 U.S.C. 154(b) by 559 days.

(21) Appl. No.: 12/589,455

(22) Filed: Oct. 23, 2009

(65) Prior Publication Data

US 2010/0127226 A1 May 27, 2010

Related U.S. Application Data

(60) Provisional application No. 61/199,867, filed on Nov. 21, 2008.

(51) Int. Cl.
*B66F 15/00* (2006.01)
*B66F 11/00* (2006.01)

(52) U.S. Cl. ..... 254/25; 254/21; 254/131.5; 254/134; 254/27; 7/166

(58) Field of Classification Search ..... 144/195.8; 254/104, 129, 131, 131.5, 132, 133 R, 134, 254/17, 20–22, 25, 26 R, 27; 269/143, 248, 269/29, 3, 6; 29/270, 278; 362/97.1; 403/329, 403/359.1, 359.5, 91, 92, 97–99; 7/166; D8/89
See application file for complete search history.

(56) References Cited

U.S. PATENT DOCUMENTS 1,375,751 A * 4/1921 Grannis ..... 254/25
2,374,530 A * 4/1945 Fiebke, Sr. ..... 254/120
2,379,387 A * 6/1945 Tessier ..... 254/131
2,520,427 A * 8/1950 Nelson ..... 254/131
2,921,773 A * 1/1960 Hoelzer ..... 254/129
3,049,337 A * 8/1962 Griggs ..... 254/131
3,168,285 A 2/1965 Russsac
3,288,437 A * 11/1966 Pederson ..... 254/132
3,476,360 A * 11/1969 Renfroe ..... 254/131
4,042,210 A 8/1977 Feldman
4,433,463 A 2/1984 Duval
4,549,350 A * 10/1985 Patillo ..... 30/170
4,582,445 A * 4/1986 Warshawsky ..... 403/97
4,905,946 A * 3/1990 Wang ..... 248/170
4,929,113 A * 5/1990 Sheu ..... 403/157
5,105,639 A 4/1992 Castricum
5,176,363 A * 1/1993 Bowlin ..... 254/131
5,322,264 A 6/1994 Giambro
5,325,576 A * 7/1994 Henderson ..... 29/426.5
5,447,289 A 9/1995 Callahan
5,581,838 A * 12/1996 Rocco ..... 15/110
5,642,591 A 7/1997 Eddie
5,820,107 A 10/1998 Hall
5,820,288 A * 10/1998 Cole ..... 403/97
5,938,177 A 8/1999 Fonda
5,957,429 A 9/1999 Khachatoorian
6,257,553 B1 7/2001 Khachatoorian
6,302,375 B1 10/2001 Alexander
6,439,542 B2 * 8/2002 Gjerde ..... 254/17
6,598,857 B1 7/2003 Hernandez
6,629,684 B2 10/2003 Youngren (Continued)

*Primary Examiner* — Lee D Wilson
*Assistant Examiner* — Tyrone V Hall, Jr.

(57) ABSTRACT

This invention relates to hand tools and more specifically to tools designed for removing deck boards or the like from floor joists to which they are attached. The embodiment is more particularly a pry bar, having a long handle, a center block coupled to the long handle and having a transverse bore therethrough, two pry arms, one attached on each side of the center block, a bore through each of the pry arms, and a shaft rotatably coupling each of the pry arms to the tool through the center block bore.

4 Claims, 6 Drawing Sheets

U.S. PATENT DOCUMENTS

| | | | | |
|---|---|---|---|---|
| 6,644,627 | B1 * | 11/2003 | Forrester | 254/17 |
| 6,959,917 | B2 | 11/2005 | Hernandez | |
| 7,036,395 | B2 | 5/2006 | Sapienza | |
| 7,185,879 | B1 | 3/2007 | Lejuez | |
| 7,278,626 | B1 * | 10/2007 | Chang | 254/25 |
| 2002/0134971 | A1 * | 9/2002 | Christensen | 254/25 |
| 2004/0026674 | A1 * | 2/2004 | Hernandez et al. | 254/25 |
| 2004/0202506 | A1 * | 10/2004 | Lazic et al. | 403/97 |
| 2006/0168818 | A1 * | 8/2006 | Outen | 30/161 |
| 2007/0169590 | A1 * | 7/2007 | Cole | 81/177.8 |
| 2008/0179576 | A1 * | 7/2008 | Cole | 254/26 R |

* cited by examiner

PRY BAR WITH ADJUSTABLE AND LOCKABLE ARMS

CROSS REFERENCE TO RELATED APPLICATIONS

This application claims the benefit of U.S. Provisional Application No. 61/199,867 filed on Nov. 21, 2008, entitled "SPECIALTY PRY BAR."

TECHNICAL FIELD

The disclosed embodiment relates to pry bars for, inter alia, removing deck boards from underlying floor joists.

BACKGROUND OF THE INVENTION

Deck floors are often built using boards, conventionally referred to as deck boards, that are laid side-by-side atop and running perpendicular to the floor joists of the deck. The deck boards are typically coupled to the joist by nails which have been driven through the deck boards into the floor joists. These deck boards, although usually treated to prevent deterioration, sometimes need to be replaced. Other times it is desired to remove the deck boards with a view to using them again, for example, deck boards that are part of a historic building.

A pry bar or hammer claw is typically used to remove deck boards. The handle of these tools act as levers to increase the force that the pry bar or claw applies to the deck boards. However, there are a number of disadvantages inherent in such tools and the use of such tools. A primary disadvantage of such tools is the inability of these tools to allow the positioning of a tool head with respect to the handle. Without the ability to position the tool head with respect to the handle, separating deck boards from the perpendicular floor joists often results in a considerable amount of damage to both the deck board and the underlying floor joist. What is desired is a pry bar having a specialty tool head that can be precisely positioned with respect to the handle so as to allow the user to retain leverage to remove the deck boards without damaging same and also to provide flexibility in how the pry bar is positioned with respect to the deck boards.

SUMMARY OF THE INVENTION

The disclosed embodiment is a pry bar having a long handle, with a nail puller, crow bar or the like on a proximate end and a tool head having a center block assembly coupling two (2) adjustable, lockable pry arms coupled to the distal end of the long handle. The center block assembly can be welded, screwed or integrally cast into the long handle.

More specifically, each of the two (2) pry arms comprise a substantially flattened plate having a first flat base, an opposing second flat base that is congruent with the first flat base and a lateral face that is orthogonal to each of the first flat base and second flat base. As used herein, the term "flat base" does not refer or imply the orientation of the element with respect to the ground as the pry arm first flat base and pry arm second flat base are substantially orthogonal to the ground or deck board when the tool is being used. The pry arm first flat base and pry arm second flat base of each pry arm are substantially circular with a pry arm extension portion which protrudes and tapers to a point. The pry arm first flat base and pry arm second flat base of each pry arm are each substantially circularly or ellipsoidally shaped for about ½ to ⅞ of the total circumference thereof with the tapered pry arm extension protruding from what would be the remaining ½ to ⅛ circular portion, but for the extension. The upper surface of the pry arm extension can have a concave shape so as to provide clearance between the pry arm and the near bottom edge of the deck board being removed thus preventing lifting the deck board at its edge, to minimize board splitting and nail bending.

Each of the two (2) pry arms have a transverse bore therethrough with internal splines around and parallel to the length of the bore, the transverse bore being parallel to the pry arm lateral face and orthogonal to each of the pry arm first flat base and pry arm second flat base.

The center block has a first base and an opposing, congruent second base, and a center block lateral face. As used herein, the term "base" does not refer or imply the orientation of the base with respect to the ground as the first base and second base are substantially orthogonal to the ground or deck board when the tool is being used. The center block has a transverse bore therethrough with internal splines around and parallel to the length of the bore, the transverse bore being parallel to the pry arm lateral face and orthogonal to each of the center block first base and center block second base. The first pry arm second base is apositioned the center block first base and the second pry arm second base is apositioned the center block second base. Hence, the splined bore of the first pry arm is aligned with a splined bore of the center block on the one side of the center block and the splined bore of the second pry arm is aligned with the splined bore of the center block on the other side of the center block. The internal splines of the two (2) pry arms and the internal bore of the center block are congruent. The splines can be triangular splines, straight tooth splines or involute splines, depending on the application of the tool and the force expected to be transferred from the handle to the pry arms. The internal bores of the pry arms and the center block are adapted to receive a shaft having splines that are keyed to, and mesh with, the internal splines of the pry arms and the center block.

The embodiment further comprises a shaft having a first end and a second end. The following description applies to a tool wherein the handle is adapted to be held by a user's left hand so that the user's right hand can cradle the pry arms and push in the shaft so as to release the pry arms from the locked position. Of course, a person skilled in the art would recognize that the embodiment can be designed by reversing of the order of elements of the shaft and tension spring below so that the handle is adapted to be held by a user's right hand and the pry arms cradled by the user's left hand when releasing the pry arms from the locked position. The embodiment covers both arrangements.

Starting at the first end, the shaft has a first splined portion, then a first smooth, machined portion, then a second splined portion and then a second, smooth machined portion at the second end. The length of the first splined portion of the shaft is substantially congruent with the length through the first pry arm bore. The length of the first machined portion of the shaft is slightly longer than the length through the first pry arm bore so as to allow the pry arm to rotate freely when the shaft is pushed into the unlocked position (when, inter alia, the first machined portion of the shaft is pushed into the first pry arm bore as detailed herein). The length of the second splined portion of the shaft is substantially the same length through the central block bore, so that when the pry arms are in the locked position, the first splined portion of the shaft is in the first pry arm bore, the entire first machined portion of the shaft is in the central block bore and a portion of the second splined portion of the shaft is in the central block bore with the remaining second splined portion of the shaft in the second pry arm bore. The length of the second machined portion of the shaft is slightly longer than the length of the second pry arm bore so as to allow the second pry arm to rotate freely when the tool is in the unlocked position and so as to accommodate a tension spring, as hereinafter described. The tension spring has a diameter that is slightly greater than that of the diameter of the second splined portion of the shaft is positioned over the second splined portion and second machined portion of the shaft at the second base of the center block.

Each of the two (2) flat ends of the shaft have a threaded partial bore in the center thereof orthogonal to its respective end adapted to receive threaded screws. At each of the two flat ends of the shaft is placed an end cap having a circular base and a tapered lateral face and a bore through the center thereof. A set screw, hex screw or other coupling means is placed through each end cap bore and then into the respective threaded partial bore of the shaft. The first end cap is coupled to the first end of the shaft and the second end cap is coupled to the second end of the shaft. The second end cap is operable to maintain the tension spring between second base of the center block and the circular base of the second end cap.

The tension spring biases the shaft such that the internal splines of the first pry arm are aligned with first splined portion of the shaft and the internal splines of the second pry arm are aligned with a portion of the second splined portion of the shaft, thus keeping the pry arms in a locked position with respect to the center block, and hence the long handle. When a force is applied to the end of the second end cap opposite the circular base, it compresses the tension spring and forces the machined portions of the shaft to align with the splined portions of each pry arm, thus allowing the pry arms to rotate freely. More specifically, when the end of the shaft is pushed into the unlocked position, the entire length of the second splined portion of the shaft is in the central block bore and the first machined portion and the second machine portion are aligned with the first pry arm bore and second pry arm bore, respectively, allowing them to rotate freely.

The embodiment is assembled by inserting the first end of the shaft through the center block bore and then through the first pry arm splined bore so that the splines of the first splined portion of the shaft are aligned with the internal splines of the first pry arm bore and the first machined portion of the shaft and a portion of the splines of the second splined portion of the shaft are aligned with the internal splines of the center block bore, thus locking them in position relative to each other. The first end cap is then coupled to the first end of the shaft. The tension spring is then inserted over the second end of the shaft and rests on the second base of the center block. The second pry arm bore is then inserted over the second end of the shaft so as to compress the tension spring against the second base of the center block. The second end cap is then coupled to the second end of the shaft.

The purpose of the center spacing block is to keep the pry arms substantially even and parallel to each other. The center spacing block is adapted to cause the pry arms to move together and also accepts any uneven or twisting forces that would otherwise be transmitted to the shaft. The center spacing block is placed between the pry arms near the center block to allow maximum travel of the pry arms during adjustment for different degree of angles for lifting. The width of the center spacing block is about the width of the lateral face of the center block and is dimensioned according to the use of the tool. If the tool is to be used with typical floor joist or framing lumber, then it is about 1½ inches in width, that is, the width of the lateral face of the center spacing block and attached center block will accommodate a single floor joist. If a double floor joist is to be accommodated, then the center spacing block has a width of 3 inches. Any other widths that are desired are encompassed by the embodiment.

An object of the present invention is to safely and efficiently separate lumber such as deck boards that have been nailed, perpendicularly, to floor joists or framing The described embodiment can further be used to remove roof decking from rafters. Using the adjustable pry arms, removal of most any type of wall board is easier, the overall design allowing for less waste of material that is being removed. A preferred embodiment of the tool is designed and shaped so as to fit over the edge width of any standard "two-by" framing material.

To those skilled in the art to which this invention relates, many changes in construction and widely differing embodiments and applications of the invention will suggest themselves without departing from the scope of the invention as defined in the claims. The disclosures and the descriptions herein are purely illustrative and are not intended to be in any sense limiting.

BRIEF DESCRIPTION OF THE DRAWINGS

For a better understanding of the described embodiment including the features, advantages and specific embodiments, reference is made to the following detailed description along with accompanying drawings in which.

In the accompanying drawings.

References in the detailed description correspond to like references in the Figures unless otherwise noted. Like numerals refer to like parts throughout the various Figures.

DETAILED DESCRIPTION OF THE PREFERRED EMBODIMENTS

While the making and using of the described embodiment are discussed in detail below, it should be appreciated that the invention provides many applicable inventive concepts which can be embodied in a wide variety of specific contexts. Some features of the embodiments shown and discussed may be simplified or exaggerated for illustrating the principles of the invention.

Figure 1:
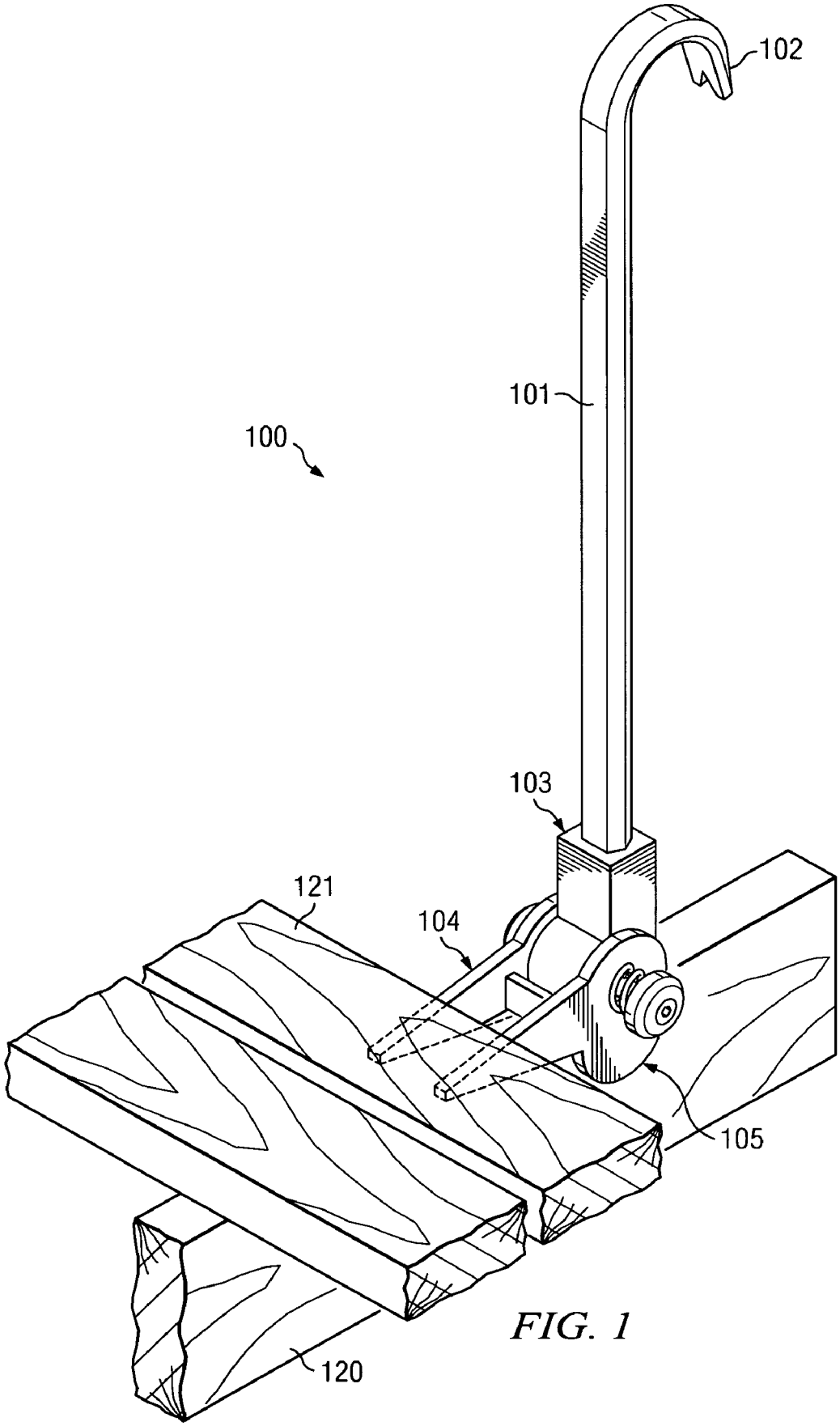
FIG. 1 is a perspective view of the embodiment being used to remove deck boards from a floor joist.

Referring now to FIG. 1, a side view of the embodiment 100 is shown being used to remove deck boards 121 from a floor joist 120. More specifically, the disclosed embodiment 100 is a pry bar having a long handle 101, with a nail puller, crow bar or the like 102 on a proximate end and a tool head having a center block assembly 103 coupling two (2) adjustable, lockable pry arms coupled to the distal end of the long handle 101. The center block assembly can be welded, screwed or integrally cast into the long handle 101.

Figure 2:
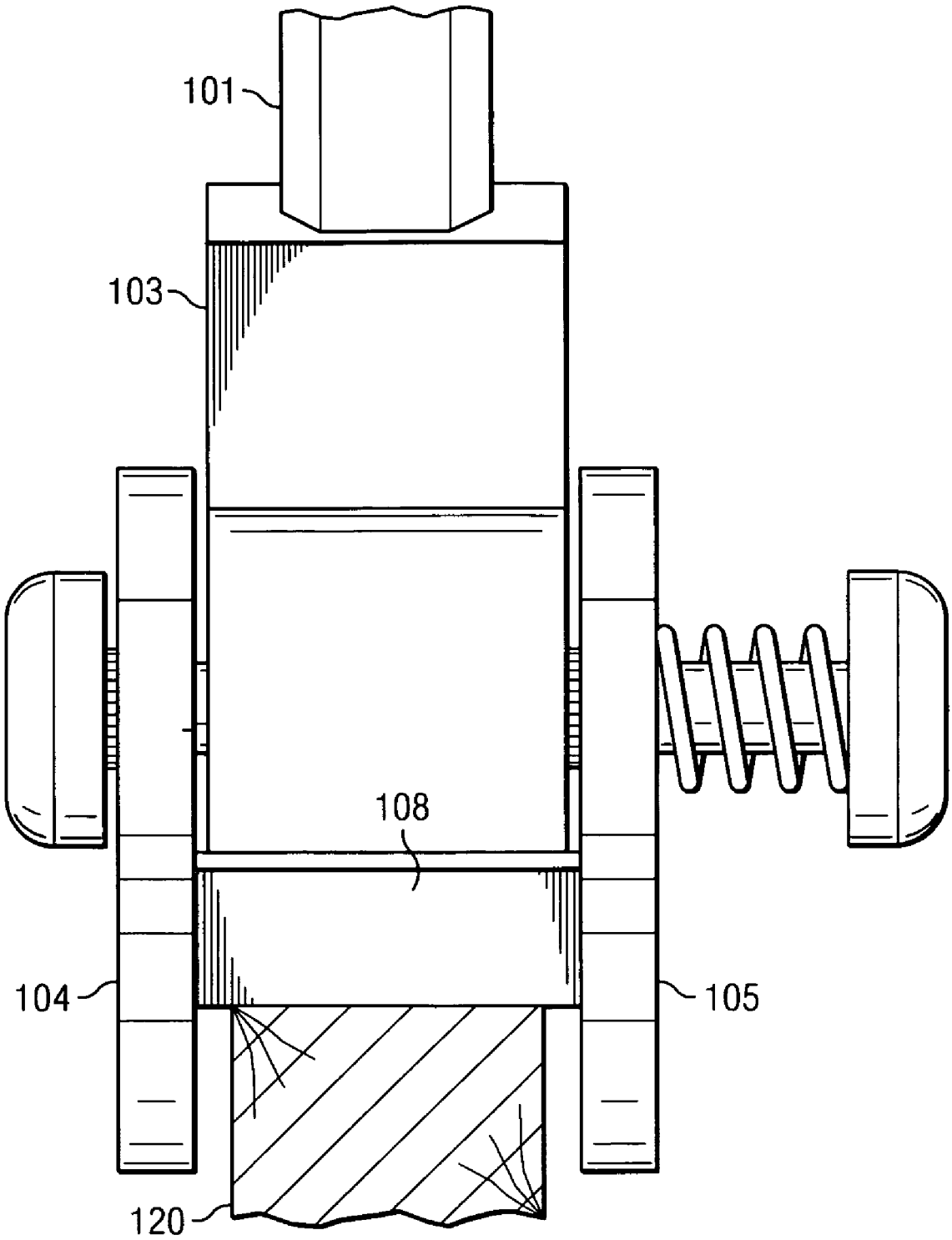
FIG. 2 is a front view the lower portion of the embodiment of the tool, with the center block on top of a floor joist and the pry arms astride the sides of the floor joist.

FIG. 2 is a front view the lower portion of the embodiment of the tool 100, with the center block 103 on top of a floor joist 120 and the pry arms 104, 105 astride the sides of the floor joist 120.

Figure 3:
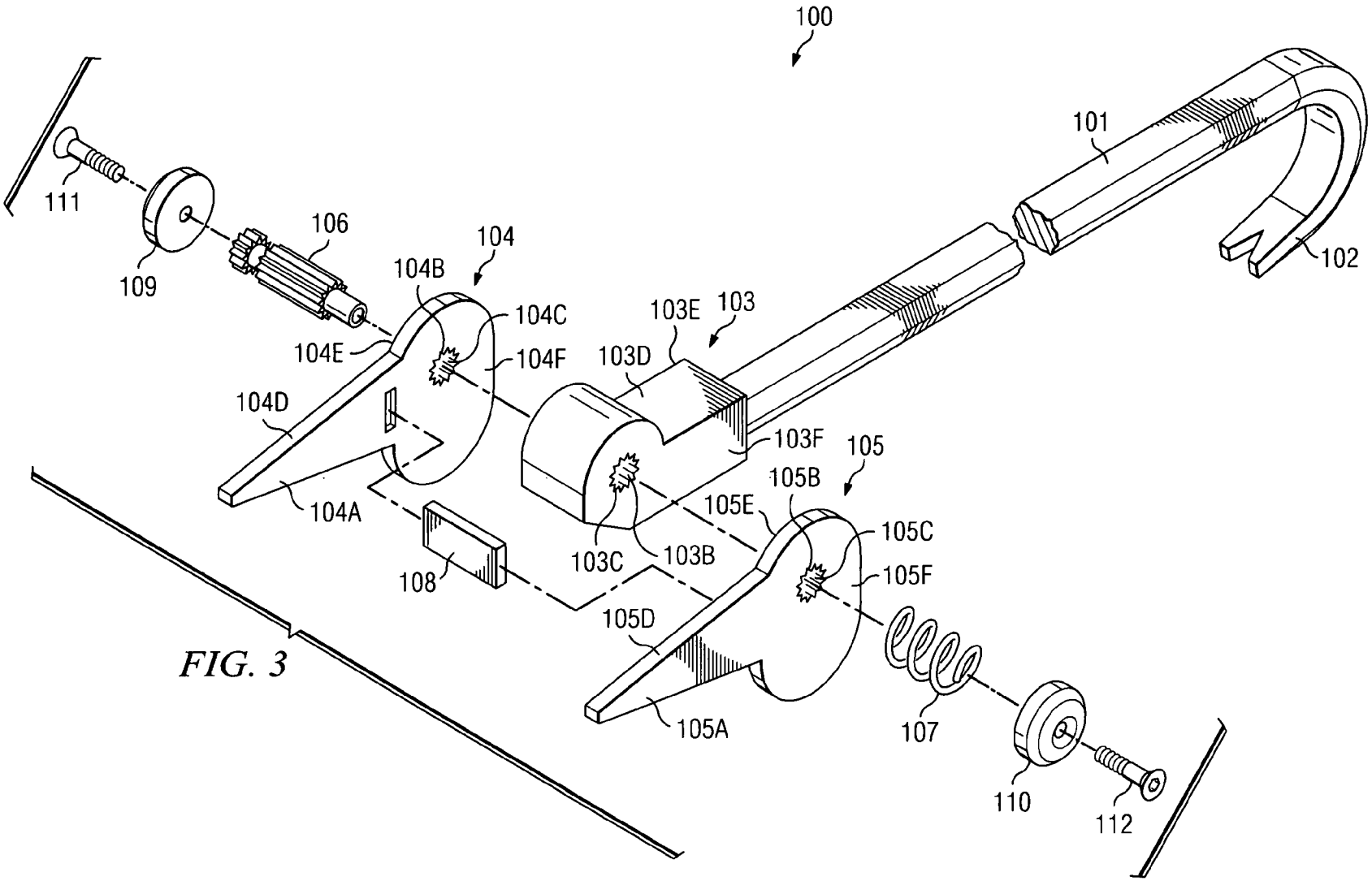
FIG. 3 is an exploded view of an embodiment.
Figure 4:
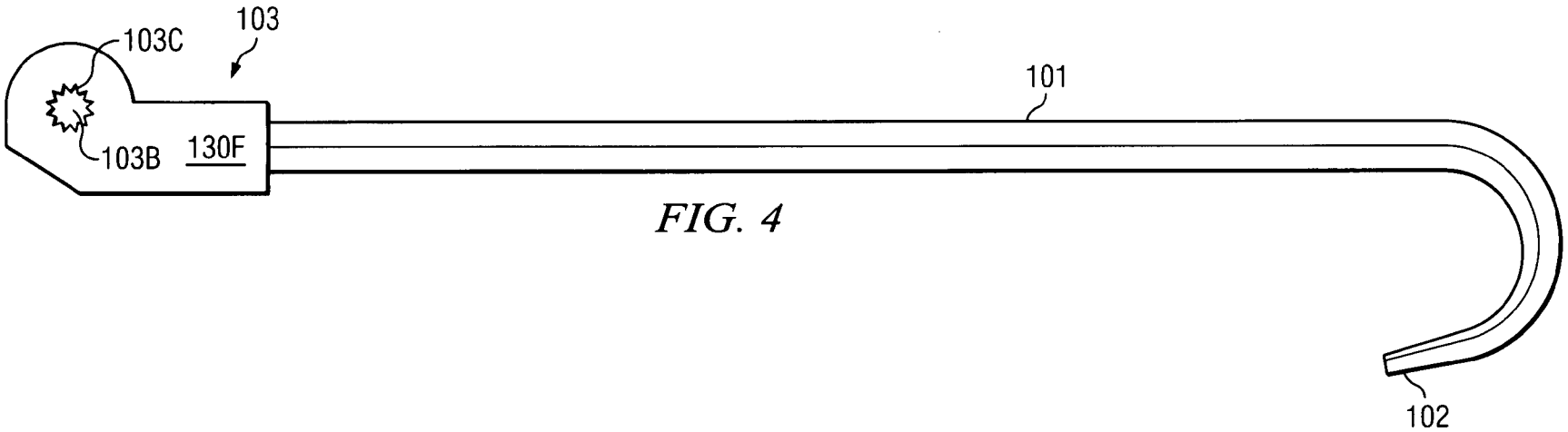
FIG. 4 is a side view of the long handle and center block of the embodiment.
Figure 6:
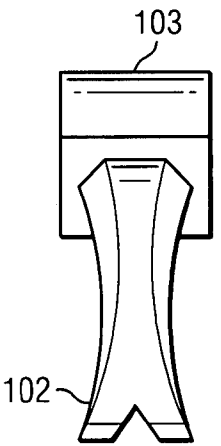
FIG. 6 is a top view of the nail puller at the proximate end of the long handle of the embodiment.

FIG. 3 is an exploded view of an embodiment showing the elements thereof. As seen therein, the disclosed embodiment is a pry bar 100 having a long handle 101, with a nail puller, crow bar or the like 102 on a proximate end and a tool head having a center block 103 coupling two (2) adjustable, lockable pry arms 104, 105 coupled to the distal end of the long handle 101. As seen in FIG. 4, the center block 103 can be welded, screwed or integrally cast into the long handle 101. A top view of a nail puller 102 at the proximate end of long handle 101 can be seen in FIG. 6.

Figure 5:
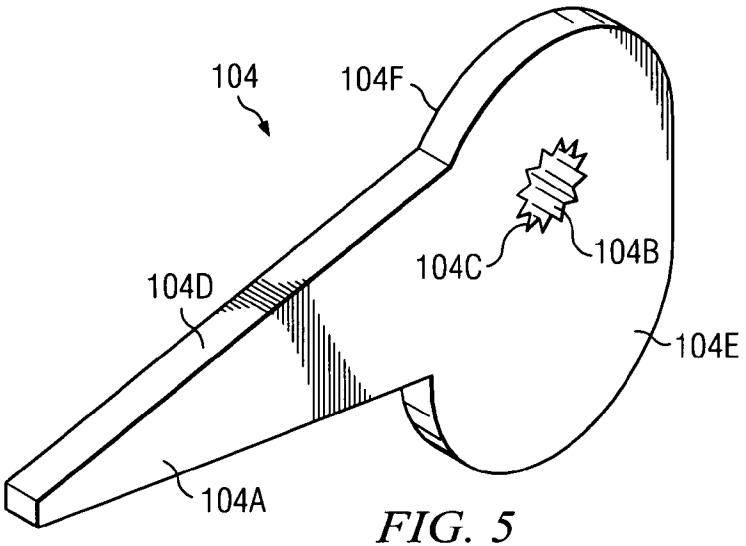
FIG. 5 is a side view one of the two pry arms of the embodiment.

Referring to FIG. 5, one of the identical two (2) pry arms is shown. Pry arm 104 comprise a substantially flattened plate having a pry arm first flat base 104E, an opposing pry arm second flat base 104F that is congruent with the pry arm first flat base 104E and a pry arm lateral face 104D that is orthogonal to each of the pry arm first flat base 104E and pry arm second flat base 104F. As used herein, the term "flat base" does not refer or imply the orientation of the element with respect to the ground as the pry arm first flat base 104E and pry arm second flat base 104F are substantially orthogonal to the ground or deck board when the tool is being used. The pry arm first flat base 104E and pry arm second flat base 104F are substantially circular with a pry arm extension 104A portion which protrudes and tapers to a point. The pry arm first flat base 104E and pry arm second flat base 104F are each substantially circularly or ellipsoidally shaped for about ½ to ⅞ of the total circumference thereof with the tapered pry arm extension 104A protruding from what would be the remaining ½ to ⅛ circular portion, but for the extension. The upper lateral surface of the pry arm extension 104A can have a concave shape so as to provide clearance between the pry arm 104 and the near bottom edge of the deck board being removed thus preventing lifting the deck board at its edge, to minimize board splitting and nail bending. Pry arm 104 has a transverse bore 104B therethrough with internal splines 104C around and parallel to the length thereof, the transverse bore 104B being parallel to the pry arm lateral face 104D and orthogonal to each of the pry arm first flat base 104E and pry arm second flat base 104. Pry arm 105 mirrors pry arm 104, it being understood that pry arm 105 has the mirrored elements, referred to as 105A-105F, as pry arm 104.

Referring back to FIG. 3, the center block 103 has a first base 103E and an opposing, congruent second base 103F, and a center block lateral face 103D. As used herein, the term "base" does not refer or imply the orientation of the base with respect to the ground as the first base and second base are substantially orthogonal to the ground or deck board when the tool is being used. The center block 103 has a transverse bore 103B therethrough with internal splines 103C around and parallel to the length of the bore, the transverse bore 103B being parallel to the pry arm lateral face 103D and orthogonal to each of the center block first base 103E and center block second base 103F. Also seen in FIG. 3 are the following: tension spring 107, center spacing block 108 and end caps 109, 110 and end cap screws 111, 112, each performing the functionality described below.

The first pry arm second base 104F is apositioned the center block first base 103F and the second pry arm second base 105F is apositioned the center block second base 103E. Hence, the splined bore 104C of the first pry arm 104 is aligned with a splined bore 103B of the center block 103 on the one side of the center block 103 and the splined bore of the second pry arm 105B is aligned with the splined bore 103B of the center block 103 on the other side of the center block 103. The internal splines 104C, 105C of the two (2) pry arms 104, 105 and the internal splines 103C of the center block 103 are congruent. The splines 103C, 104C, 105C can be triangular splines, straight tooth splines or involute splines, depending on the application of the tool and the force expected to be transferred from the handle to the pry arms 104, 105. The internal bores 103B, 104B, 105B of the pry arms 104, 105 and the center block 103 are adapted to receive a shaft 106 having splines that are keyed to, and mesh with, the internal splines 103C, 104C, 105C of the pry arms 104, 105 and the center block 103.

Figure 7:
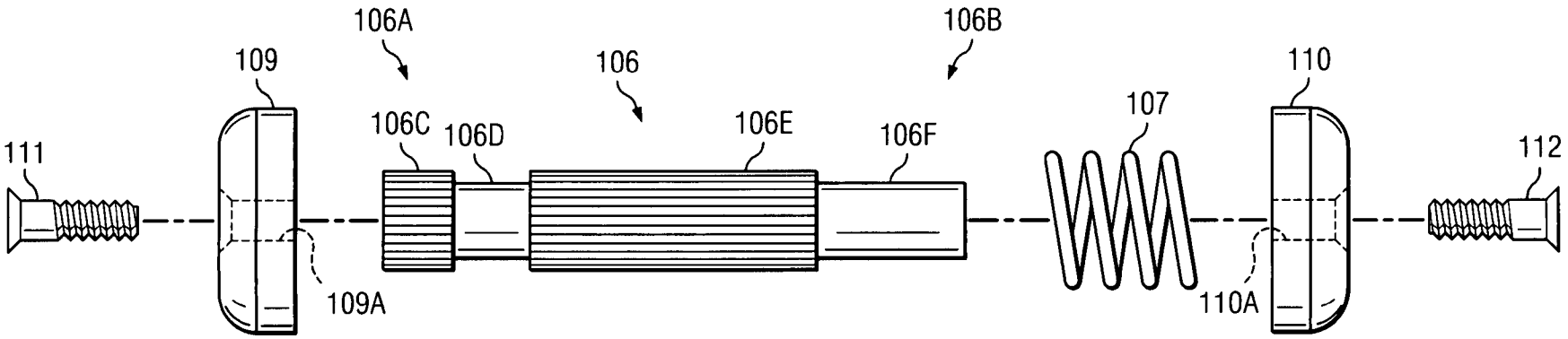
FIG. 7 is an exploded view of the shaft and related elements of the embodiment.
Figure 8:
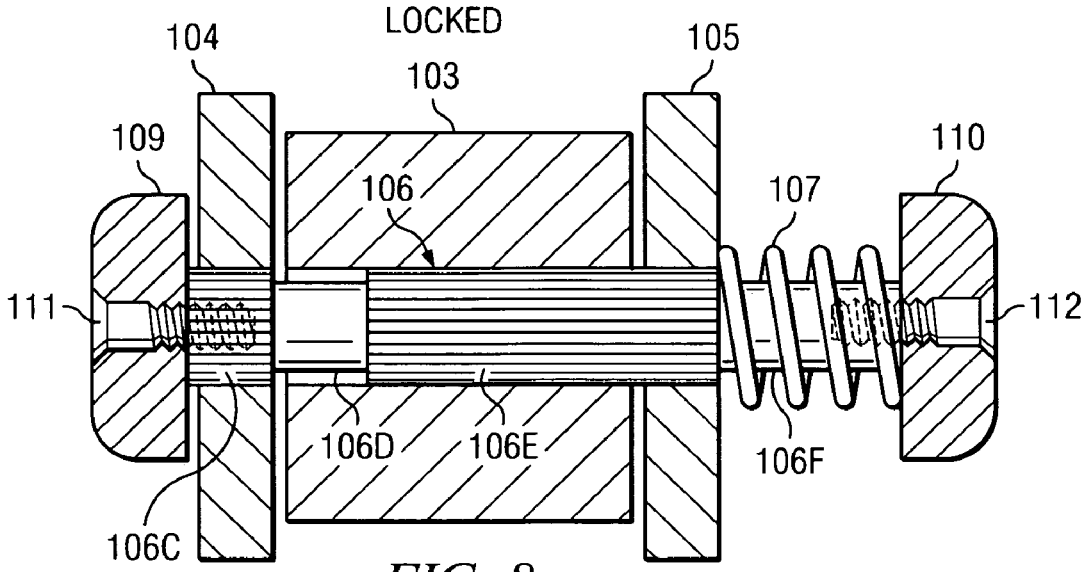
FIG. 8 is a view of the shaft and related elements through the pry arm and center block bores in the locked position.
Figure 9:
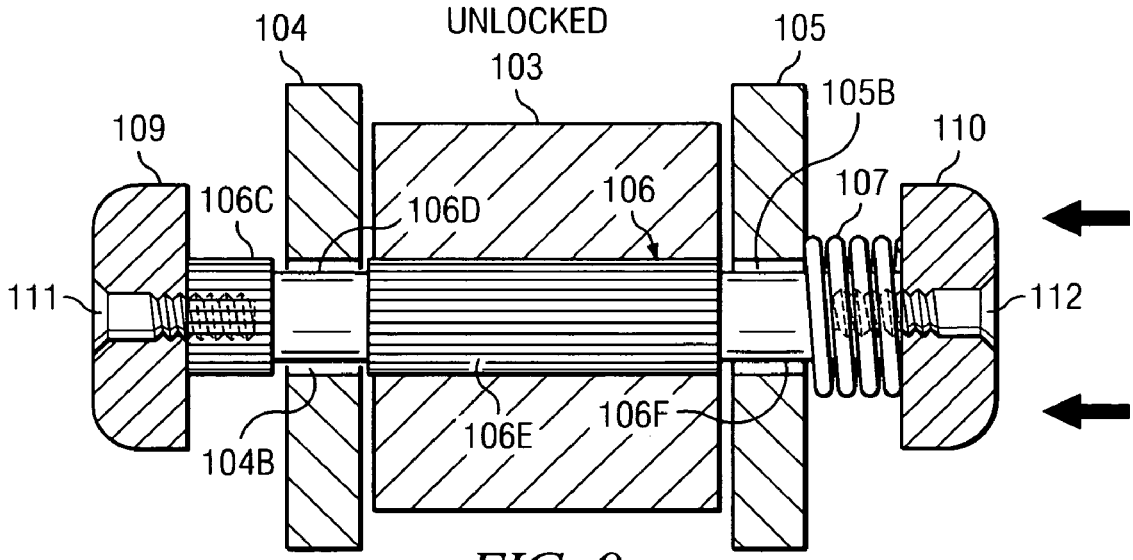
FIG. 9 is a view of the shaft and related elements through the pry arm and center block bores in the unlocked position.

The following description of FIGS. 7-9 applies to a tool 100 wherein the handle 101 is adapted to be held by a user's left hand so that the user's right hand can cradle the pry arms 104, 105 and push in the shaft 106 so as to release the pry arms 104, 105 from the locked position. Of course, a person skilled in the art would recognize that the embodiment can be designed by reversing of the order of elements of the shaft and tension spring defined below so that the handle 101 is adapted to be held by a user's right hand and the pry arms 104, 105 cradled by the user's left hand when releasing the pry arms 104, 105 from the locked position. The embodiment covers both arrangements.

As noted in FIG. 7, the embodiment further comprises a shaft 106 having a first end 106A and a second end 106B. Starting at the first end, the shaft has a first splined portion 106C, then a first smooth, machined portion 106D, then a second splined portion 106E and then a second, smooth machined portion 106F at the second end 106B.

Referring to FIGS. 8 and 9, the length of the first splined portion 106C of the shaft is substantially congruent with the length through the first pry arm bore 104B. The length of the first machined portion 106D of the shaft is slightly longer than the length through the first pry arm bore 104B so as to allow the pry arm 104 to rotate freely when the shaft 106 is pushed into the unlocked position (when, inter alia, the first machined portion 106D of the shaft is pushed into the first pry arm bore 104B as detailed herein) as seen in FIG. 9. The length of the second splined portion 106E of the shaft 106 is substantially the same length through the central block bore 103B, so that when the pry arms 104, 105 are in the locked position, the first splined portion 106C of the shaft 106 is in the first pry arm bore 104B, the entire first machined portion 106D of the shaft 106 is in the central block bore 103B and a portion of the second splined portion 106E of the shaft 106 is in the central block bore 103B with the remaining second splined portion 106E of the shaft 106 in the second pry arm bore 105B, as seen in FIG. 8. The length of the second machined portion 106F of the shaft 106 is slightly longer than the length of the second pry arm bore 105B so as to allow the second pry arm 105 to rotate freely when the tool is in the unlocked position and so as to accommodate tension spring 107, as hereinafter described.

Tension spring 107 has a diameter that is slightly greater than that of the diameter of the second splined portion 106E of the shaft 106 and is positioned over the second splined portion 106E and second machined portion 106F of the shaft 106 at the second base 103F of the center block 103.

Each of the two (2) flat ends 106A, 106B of the shaft 106 have a threaded partial bore in the center thereof orthogonal to its respective end adapted to receive threaded screws 111, 112, respectively. At each of the two flat ends 106A, 106B of the shaft 106 is placed an end cap 109, 110 having a circular base and a tapered lateral face and a bore 109A, 110A, respectively through each center thereof. A set screw, hex screw or other coupling means 111, 112 is placed through each end cap bore 109A, 110A and then into the respective threaded partial bore of the shaft 106. The first end cap 109 is coupled to the first end of the shaft 106A and the second end cap 110 is coupled to the second end of the shaft 106B. The second end cap 110 is operable to maintain the tension spring 107 between second base 103F of the center block 103 and the circular base of the second end cap 110.

Tension spring 107 biases the shaft 106 such that the internal splines 104C of the first pry arm 104 are aligned with first splined portion 106C of shaft 106 and the internal splines 105C of the second pry arm 105 are aligned with a portion of the second splined portion 106E of the shaft 106, thus keeping the pry arms 104, 105 in a locked position with respect to the center block 103, and hence the long handle 101, a seen in FIG. 8. When a force is applied to the end of the second end cap 110 opposite the circular base, it compresses the tension spring 107 and forces the machined portions 106D, 106F of the shaft 106 to align with the splined portions 104C, 105C of each pry arm 104, 105, thus allowing pry arms 104, 105 to rotate freely. More specifically, when the end of the shaft 106 is pushed into the unlocked position as seen in FIG. 9, the entire length of the second splined portion 106E of the shaft 106 is in the central block bore 103C and the first machined portion 106D and the second machined portion 106F are aligned with the first pry arm bore 104B and second pry arm bore 105B, respectively, allowing them to rotate freely.

As seen in FIGS. 8 and 9, the embodiment is assembled by inserting the first end 106A of the shaft 106 through the center block bore 103B and then through the first pry arm splined bore 104B so that the splines of the first splined portion 106C of the shaft 106 are aligned with the internal splines of the first pry arm bore 104B and the first machined portion 106D of the shaft 106 and a portion of the splines of the second splined portion 106E of the shaft 106 are aligned with the internal splines of the center block bore 103C, thus locking them in position relative to each other. The first end cap 109 is then coupled to the first end of the shaft 106A using, for example, hex screw 111. The tension spring 107 is then inserted over the second end 106B of the shaft 106 and rests on the second base 103F of the center block 103. The second pry arm bore 105B is then inserted over the second end 106B of the shaft 106 so as to compress the tension spring 107 against the second base 103F of the center block 103. The second end cap 110 is then coupled to the second end 106B of the shaft 106 using, for example, hex screw 112.

Referring back to FIG. 3, a center spacing block 108 is coupled between the pry arms 104, 105. The purpose of the center spacing block 108 is to keep the pry arms 104, 105 parallel to each other. The center spacing block 108 is adapted to cause the pry arms 104, 105 to move in unison when unlocked from the center block and adjusted also accepts any twisting forces that would otherwise be transmitted to the shaft 106. The center spacing block 103 is coupled between the pry arms 104, 105 near the center block 103 to allow maximum travel of the pry arms 104, 105 during adjustment for different degrees of angles for lifting. The width of the center spacing block 108 is about the width of the lateral face 103D of the center block 103 and is dimensioned according to the use of the tool 100. If the tool 100 is to be used with typical floor joist or framing lumber, then it is about 1½ inches in width, that is, the width of the lateral face 103D of the center block 103 and attached center spacing block 108 will accommodate a single floor joist. If a double floor joist is to be accommodated, then the center spacing block 108 has a width of 3 inches. Any other widths that are desired are encompassed by the embodiment. As would be understood by one skilled in the art, the shaft 106 would also be dimensioned based on the width of the lumber to be accommodated.

The sizes and proportions given are those presently preferred; however, the embodiment is subject to variations and modifications. For example, in further embodiments, the pry arms are flat and rounded on one end (heal) and have an elongated shape to a point on the other end. The tapered shape begins with a point on one end and enlarging toward the rounded end to approximately 3½ inches in height by ¼ inches in width. The heal is in a basic circular shape that is part of the total shape of each pry arm. The center block is constructed of hardened steel. It can be approximately 1⅝ in width to accommodate a single floor joist, and has a slightly L shape when viewed side on. The L shape of the center block has the long handle welded in the lateral face at the top of the L with the shaft inserted into the transverse bore which is located in the lower outside portion of the L. This shape provides the tool with a powerful lifting ability. This tool is then best utilized by placing the center spacing block on top of the framing material or floor joist with the pry arms on either side of the material. The end caps attached to the shaft can be comprised of stainless steel end caps held in place with Allen head set screws in the center of each. The splined shaft provide an ability to index and adjust the positions of the pry arms. The splined shaft is machined cut to correspond to the width of the center block and pry arms as described herein. The long handle is of common design and is in the shape of a standard 30 inch pry bar or crow bar. The long handle has a proximate end which is the longer rounded shaped end for pulling nails. The distal end can be blunt cut and welded into the center block. The long handle may be entirely straight, but preferably, it has a bend at it proximate end at which is integrated a nail puller of crow bar. The angle of the long handle with respect to the pry arms can be adjusted via the center block assembly to suit the situation and the user, enabling the user to either to pull up or to push down on the handle to remove boards. One or both of the prying arm tips may be provided with a wedge-shaped slot (not shown) so as to be useful for pulling nails from the boards once the boards have been removed from the deck. The rounded shaped at the proximate end is in straight alignment with the pry arms that are attached to the center block. A small spring can be placed inside the heal portion of the center block and held in place with a set screw. This spring can then push against the shaft so as to create the tension needed to hold the shaft in position when it is placed in the left or right position (locked or unlocked). The center spacing block can further comprise a solid steel spacing block that is welded between the two prying arms. This center spacing block holds the pry arms in alignment with each other. The pry arm extensions are designed with sufficient length to maintain contact between the lifting surfaces and the deck board until the nails are fully withdrawn. Because of the smooth rounded surface provided by the lateral face of the center block, there is minimal damage to the top surfaces of the floor joists. Furthermore, the two pry arms distribute lifting forces over a substantial area on the bottom of the deck boards, minimizing surface damage and board splitting. The embodiment is not limited to use in removing deck boards from floor joists. It may also be used to remove roof decking from rafters, wall boards from studs, or wherever boards are attached to supporting structures. In light of the foregoing additional embodiments, the foregoing description and the accompanying drawings should be interpreted as only illustrative of the invention defined by the following claims.

I claim:

1. A tool for removing deck boards from floor joists, said tool comprising:

a long handle having a proximate end and a distal end;

a center block located at the distal end, a pair of adjustable pry arms rotatably coupled using a shaft to the center block, said pry arms being spaced from one another sufficiently to straddle at least one floor joist when the center block is placed on top of the floor joist;

wherein, the center block has an first base and an opposing, congruent second base, and a center block lateral face, a transverse bore therethrough with internal splines around and parallel to the length of the bore to receive a shaft, the transverse bore being parallel to the pry arm lateral face and orthogonal to each of the center block first base and center block second base;

a center spacing block coupling a first pry arm second flat base to a second pry arm first flat base, wherein the first pry arm second flat base is a positioned the center block first base and the second pry arm second flat base is apositioned the center block second base;

a shaft having a first end and a second end, commencing at the first end, the shaft having a first splined portion, then a first smooth, machined portion, then a second splined portion and then a second, smooth machined portion at the second end;

the splined bore of the first pry arm being aligned with a splined bore of the center block on the one side of the center block and the splined bore of the second pry arm being aligned with the splined bore of the center block on the other side of the center block, the internal splines of the two (2) pry arms and the internal splines of the center block being congruent;

the internal bores of the pry arms and the center block receiving the shaft, the splines thereof being keyed to, and mesh with, the internal splines of the pry arms and the center block, wherein the length of the first splined portion of the shaft is substantially congruent with the length through the first pry arm bore;

the length of the first machined portion of the shaft being slightly longer than the length through the first pry arm bore so as to allow the pry arm to rotate freely when the shaft is pushed into the unlocked position and the length of the second splined portion of the shaft being substantially the same length through the central block bore, so that when the two pry arms are in the locked position, the first splined portion of the shaft is in the first pry arm bore, the entire first machined portion of the shaft is in the central block bore and a portion of the second splined portion of the shaft is in the central block bore with the remaining second splined portion of the shaft in the second pry arm bore;

the length of the second machined portion of the shaft being slightly longer than the length of the second pry arm bore so as to allow the second pry arm to rotate freely when the tool is in the unlocked position and so as to accommodate a tension spring; and a tension spring inserted over the shaft inserted through the transverse bore, the shaft having a first end cap and a second end cap coupled to the shaft using respective end cap screws, the tension spring having a diameter that is slightly greater than that of the diameter of the second splined portion of the shaft and is positioned over the second splined portion and second machined portion of the shaft at the second base of the center block, further wherein the tension spring biases the shaft such that the internal splines of the first pry arm are aligned with first splined portion of the shaft and the internal splines of the second pry arm are aligned with a portion of the second splined portion of the shaft, thus keeping the pry arms in a locked position with respect to the center block and hence in a locked position with respect to the long handle;

wherein, when a force is applied to the second end cap, it compresses the tension spring and forces the machined portions of the shaft to align with the splined portions of each pry arm, thus allowing pry arms to rotate freely.

2. A tool for removing deck boards from floor joists, said tool comprising:

a long handle having a proximate end and a distal end;

a center block located at the distal end, a pair of adjustable pry arms rotatably coupled using a shaft to the center block, said pry arms being spaced from one another sufficiently to straddle at least one floor joist when the center block is placed on top of the floor joist, wherein, the center block has an first base and an opposing, congruent second base, and a center block lateral face, a transverse bore therethrough with internal splines around and parallel to the length of the bore to receive a shaft, the transverse bore being parallel to the pry arm lateral face and orthogonal to each of the center block first base and center block second base;

a center spacing block coupling a first pry arm second flat base to a second pry arm first flat base, wherein the first pry arm second flat base is a positioned the center block first base and the second pry arm second flat base is a positioned the center block second base;

a shaft having a first end and a second end, commencing at the first end, the shaft having a first splined portion, then a first smooth, machined portion, then a second splined portion and then a second, smooth machined portion at the second end;

the splined bore of the first pry arm being aligned with a splined bore of the center block on the one side of the center block and the splined bore of the second pry arm being aligned with the splined bore of the center block on the other side of the center block, the internal splines of the two (2) pry arms and the internal splines of the center block being congruent;

the internal bores of the pry arms and the center block receiving the shaft, the splines thereof being keyed to, and mesh with, the internal splines of the pry arms and the center block, wherein the length of the first splined portion of the shaft is substantially congruent with the length through the first pry arm bore;

the length of the first machined portion of the shaft being slightly longer than the length through the first pry arm bore so as to allow the pry arm to rotate freely when the shaft is pushed into the unlocked position and the length of the second splined portion of the shaft being substantially the same length through the central block bore, so that when the two pry arms are in the locked position, the first splined portion of the shaft is in the first pry arm bore, the entire first machined portion of the shaft is in the central block bore and a portion of the second splined portion of the shaft is in the central block bore with the remaining second splined portion of the shaft in the second pry arm bore;

the length of the second machined portion of the shaft being slightly longer than the length of the second pry arm bore so as to allow the second pry arm to rotate freely when the tool is in the unlocked position and so as to accommodate a tension spring; and a tension spring inserted over the shaft inserted through the transverse bore, the shaft having a first end cap and a second end cap coupled to the shaft using respective end cap screws, the tension spring having a diameter that is slightly greater than that of the diameter of the second splined portion of the shaft and is positioned over the second splined portion and second machined portion of the shaft at the second base of the center block, further wherein the tension spring biases the shaft such that the internal splines of the first pry arm are aligned with first splined portion of the shaft and the internal splines of the second pry arm are aligned with a portion of the second splined portion of the shaft, thus keeping the pry arms in a locked position with respect to the center block and hence in a locked position with respect to the long handle;

wherein when the shaft is pushed into the unlocked position, the entire length of the second splined portion of the shaft is in the central block bore and the first machined portion and the second machined portion are aligned with the first pry arm bore and second pry arm bore, respectively, allowing them to rotate freely.

3. The tool of claim 2, wherein the shaft is cylindrical in shape having a bottom base and top base comprising two (2) flat ends, each of the flat ends of the shaft include a threaded partial bore in the center thereof orthogonal to its respective end adapted to receive threaded screws;

a first end cap coupled to the flat end at the bottom base and a second end cap coupled at the flat end of the top base of the shaft, each end cap having a circular base and a tapered lateral face and a bore, respectively through each center thereof; and a set screw or hex screw being positioned through each end cap bore and then into the respective threaded partial bore of the shaft.

4. The tool of claim 3, wherein the first end cap is coupled to the first end of the shaft and the second end cap is coupled to the second end of the shaft, the second end cap operable to maintain the tension spring between second base of the center block and the circular base of the second end cap.

* * * * *